US008561546B2

(12) United States Patent
Liu et al.

(10) Patent No.: US 8,561,546 B2
(45) Date of Patent: Oct. 22, 2013

(54) BOGIE

(75) Inventors: Zhenming Liu, Heilongjiang (CN); Chunlin Wang, Heilongjiang (CN); Shihui Duan, Heilongjiang (CN); Pingwei Yin, Heilongjiang (CN); Hai Yao, Heilongjiang (CN)

(73) Assignee: Qiqihar Railway Rolling Stock Co., Ltd., Heilongjiang (CN)

( * ) Notice: Subject to any disclaimer, the term of this patent is extended or adjusted under 35 U.S.C. 154(b) by 153 days.

(21) Appl. No.: 13/177,800

(22) Filed: Jul. 7, 2011

(65) Prior Publication Data

US 2013/0008337 A1 Jan. 10, 2013

(51) Int. Cl.
*B61F 3/00* (2006.01)
*B61F 5/00* (2006.01)

(52) U.S. Cl.
USPC ..... 105/197.05; 105/193

(58) Field of Classification Search
USPC ..... 105/157.1, 182.1, 193, 197.05, 198.1, 105/198.2, 226
See application file for complete search history.

(56) References Cited

U.S. PATENT DOCUMENTS 5,875,721 A * 3/1999 Wright et al. ..... 105/198.2
7,263,931 B2 * 9/2007 Forbes ..... 105/223

* cited by examiner

*Primary Examiner* — R.J. McCarry, Jr.
(74) *Attorney, Agent, or Firm* — J.C. Patents

(57) ABSTRACT

The invention provides a bogie which comprises a bolster, two side frames and four constant contact dampers, two sides of two ends of the bolster are respectively provided with a wedge pocket; the four constant contact dampers are respectively arranged in four wedge pockets, and each of the four constant contact dampers comprises a wedge and a damping spring; the damping spring is arranged in an inner cavity of the wedge; one end of the damping spring bears against a top inner surface of the inner cavity of the wedge, and the other end of the damping spring bears against a bottom plate of the wedge pocket, wherein the bogie further comprises four through holes and four ejectors which respectively correspond to the four constant contact dampers; the through holes are arranged on the bottom plate, and the position of each of the four through holes on the bottom plate corresponds to the position where the damping spring bears against the bottom plate and a load spring of the bogie; and one end of the ejector penetrates into the damping spring, and the other end of the ejector bears against the load spring through the through hole. The bogie of the present invention solves the technical problem that the deformation of the damping springs keeps constant whether a car is empty or loaded in the prior art, and thus improves the damping effect of the bogie.

6 Claims, 6 Drawing Sheets

BOGIE

FIELD OF THE TECHNOLOGY

The present invention relates to railway mechanical field, and more particularly to a bogie.

BACKGROUND

Since a bogie is an important component of a whole railway car, research in dynamic performance of a bogie is always the striving direction for those skilled in the art.

FIG. 1 is a partial three dimensional view of a bogie with a constant contact damper in the prior art. FIG. 2 is another partial three dimensional view of the bogie with the constant contact damper in the prior art. FIG. 3 is a partial side view of the bogie with the constant contact damper in the prior art. Referring to FIG. 1, FIG. 2 and FIG. 3, the bogie in the prior art comprises a bolster 11, two side frames 12 and four constant contact dampers. Two sides of two ends of the bolster 11 are respectively provided with a wedge pocket 111. A load spring 14 does not penetrate through a bottom plate 1111 of the wedge pocket 111. Each constant contact damper comprises a wedge 131, a damping spring 132, a side frame column wear plate 133 and a bolster inclined plane wear plate 134. The wedge 131 is a groove body, and is arranged in the wedge pocket 111 and latched on the bottom plate 1111. The damping spring 132 is arranged in the groove body with one end bearing against the top inner surface of the groove body and the other end bearing against the bottom plate 1111 in a compression state. The side frame column wear plate 133 is arranged on the side frame 12 and bears against the vertical plane of the wedge 131. The bolster inclined plane wear plate 134 is arranged in the wedge pocket 111 of the bolster 11 and bears against the inclined plane of the wedge 131.

When the car is running, the load spring 14 is compressed and generates spring bearing force along with the up and down vibration of the bolster 11 due to the gravitation of the empty car or loaded car. The friction damper can convert the vertical support force of the damper spring 132 to a horizontal lateral pressure on the side frame 12 and an inclined plane lateral pressure on the wedge pocket 111 from the wedge 131, causing a friction between the vertical plane of the wedge 131 and the side frame column wear plate 133, as well as a friction between the inclined plane of the wedge 131 and the bolster inclined plane wear plate 134 to generate damping forces. A relative friction coefficient of the friction damper can be obtained by the ratio between the damping forces and the support force of the spring. Those skilled in the art commonly appreciate that the relative friction coefficient is an important parameter for the damping effect implemented by the constant contact damper. Thereby, keeping the relative friction coefficient in an ideal numerical range whether the car is empty or loaded is a research goal.

Based what is described above, the inventor found in a long-term practice of the art that though the anti-lozenge deformation rigidity of the bogie is guaranteed with the aid of the large lateral dimension of the inclined plane of the wedge 131 along the car, the deformation of the damping spring 132 keeps constant whether the car is empty or loaded, which makes the damping force generated by the vertical support force of the damping spring 132 keep unchanged all the time, and eventually the relative friction coefficient can not be kept in an ideal numerical range when the car is empty and when the car is loaded, and thus the damping effect of the bogie is reduced.

SUMMARY

The present invention provides a bogie for solving the technical problem in the prior art that the damping effect of the bogie is reduced due to the deformation of the damping spring keeping constant whether a car is empty or loaded.

The present invention provides a bogie which comprises a bolster, two side frames and four constant contact dampers, two sides of two ends of the bolster are respectively provided with a wedge pocket; the four constant contact dampers are respectively arranged in four wedge pockets, and each of the constant contact dampers comprises a wedge and a damping spring; the damping spring is arranged in an inner cavity of the wedge; one end of the damping spring bears against a top inner surface of the inner cavity of the wedge, and the other end of the damping spring bears against a bottom plate of the wedge pocket, wherein the bogie further comprises four through holes and four ejectors which respectively correspond to the four constant contact dampers.

The through holes are arranged on the bottom plate, and the position of each of the through holes on the bottom plate corresponds to the position where the damping spring bears against the bottom plate and a load spring of the bogie.

One end of the ejector penetrates into the damping spring, and the other end of the ejector bears against the load spring through the through hole.

The bogie of the present invention adopts the structure that through holes are arranged on the bottom plate of the wedge pocket of the bolster and one end of the ejector penetrates into the damping spring, and the other end of the ejector bears against the load spring through the through hole. When the car is empty, a predetermined distance between one end of the ejector and the inner surface top of the inner cavity of the wedge is reserved; and when the car is loaded, the load spring is compressed to bear against the other end of the ejector such that one end of the ejector bears against the top inner surface of the inner cavity of the wedge. The present invention solves the problem that deformation of the damping spring keeps unchanged whether the car is empty or loaded such that the damping effect of the bogie is reduced in the prior art, and improves the damping effect of the bogie.

DETAILED DESCRIPTION

Figure 1:
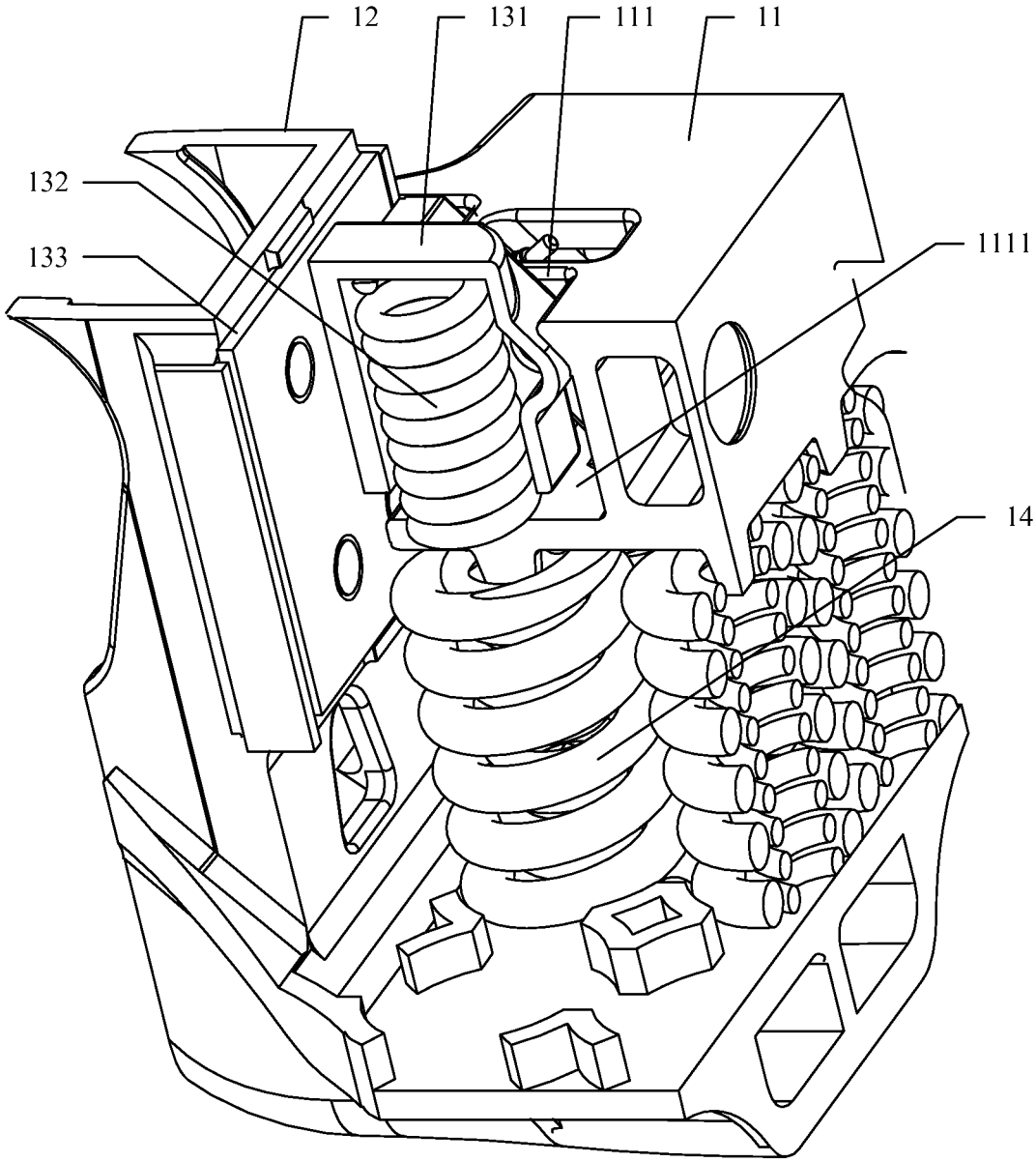
FIG. 1 is a partial three dimensional view of a bogie with a constant contact damper in the prior art.
Figure 2:
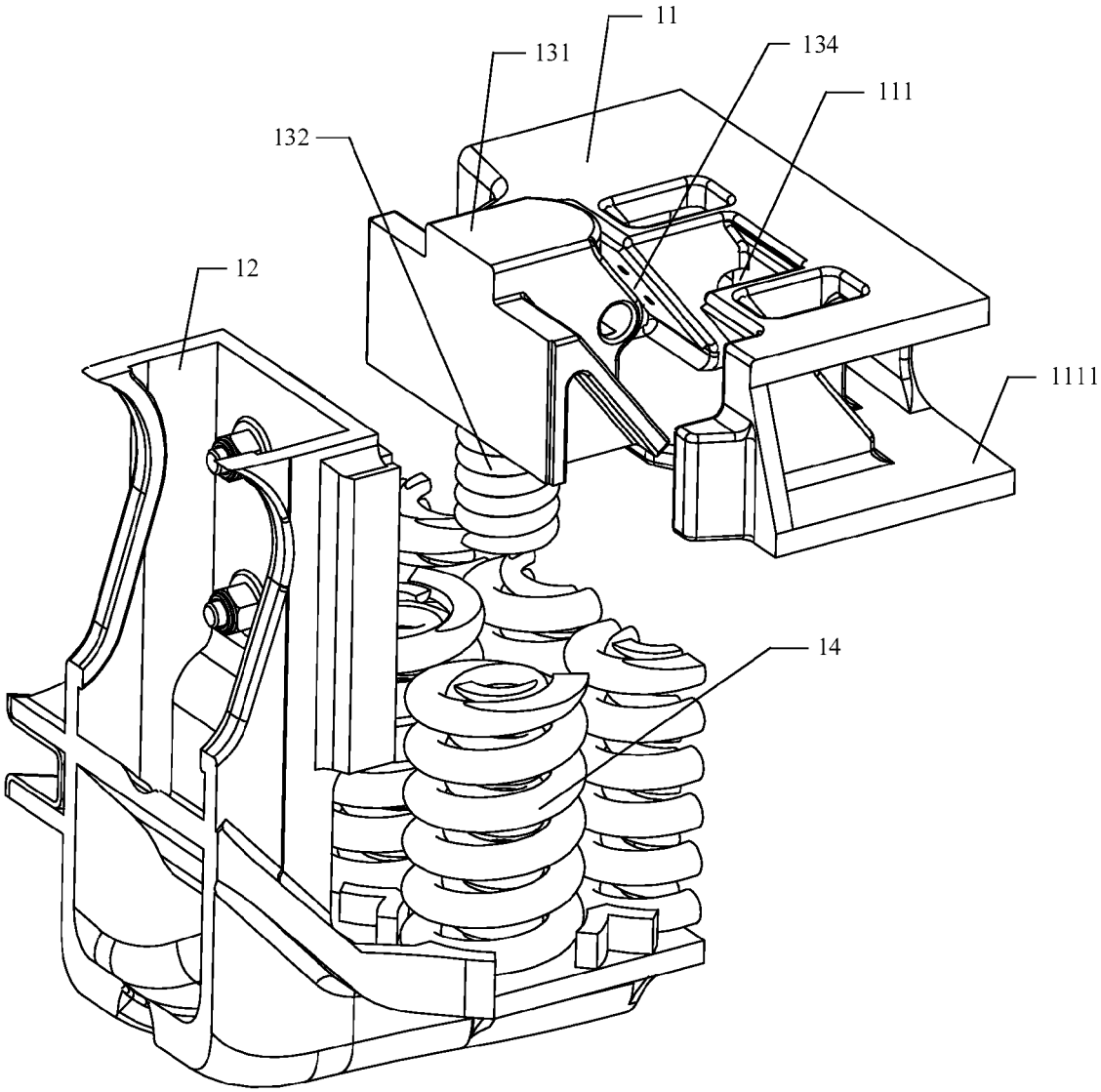
FIG. 2 is another partial three dimensional view of the bogie with the constant contact damper in the prior art.
Figure 3:
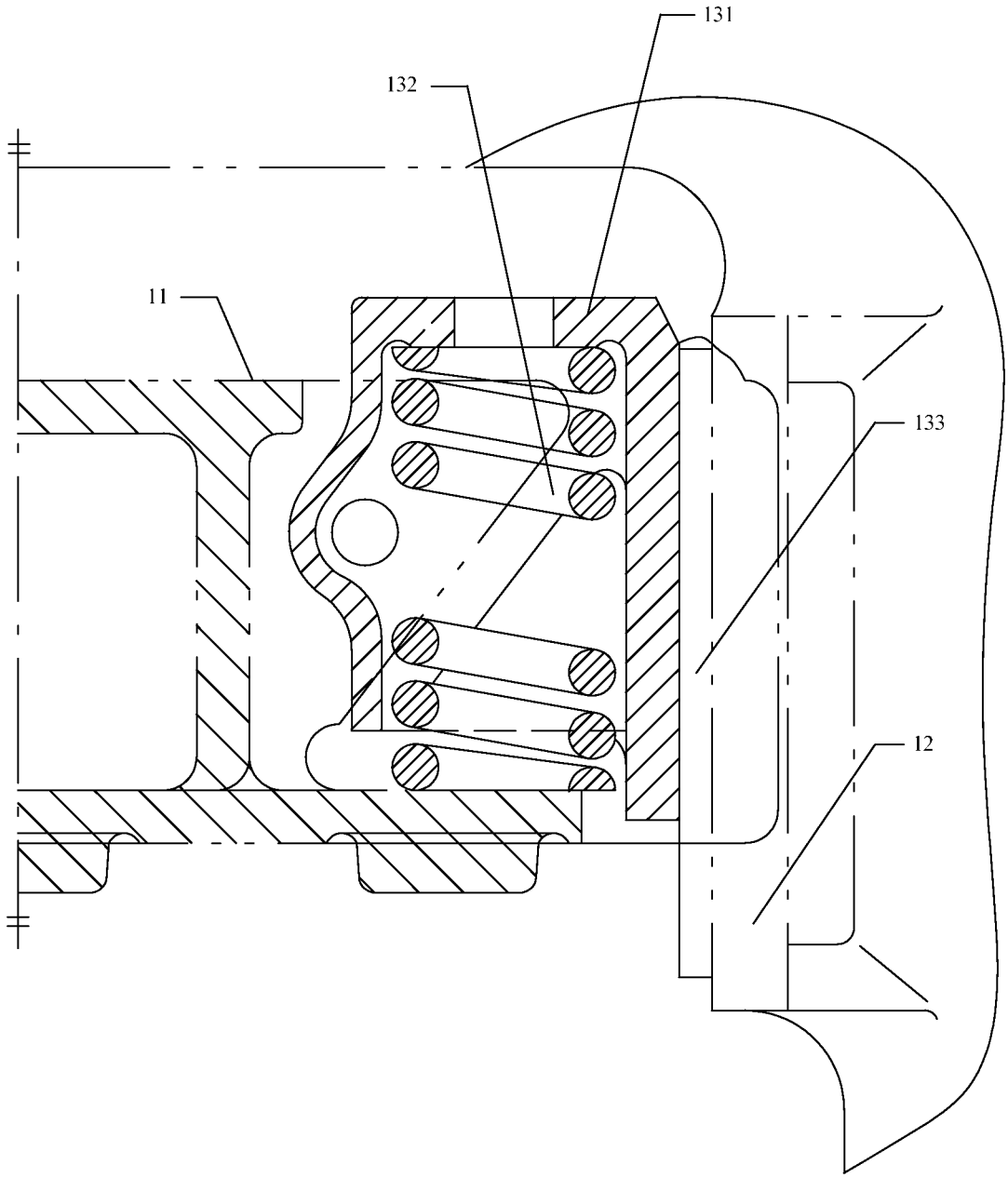
FIG. 3 is a partial side view of the bogie with the constant contact damper in the prior art.
Figure 4:
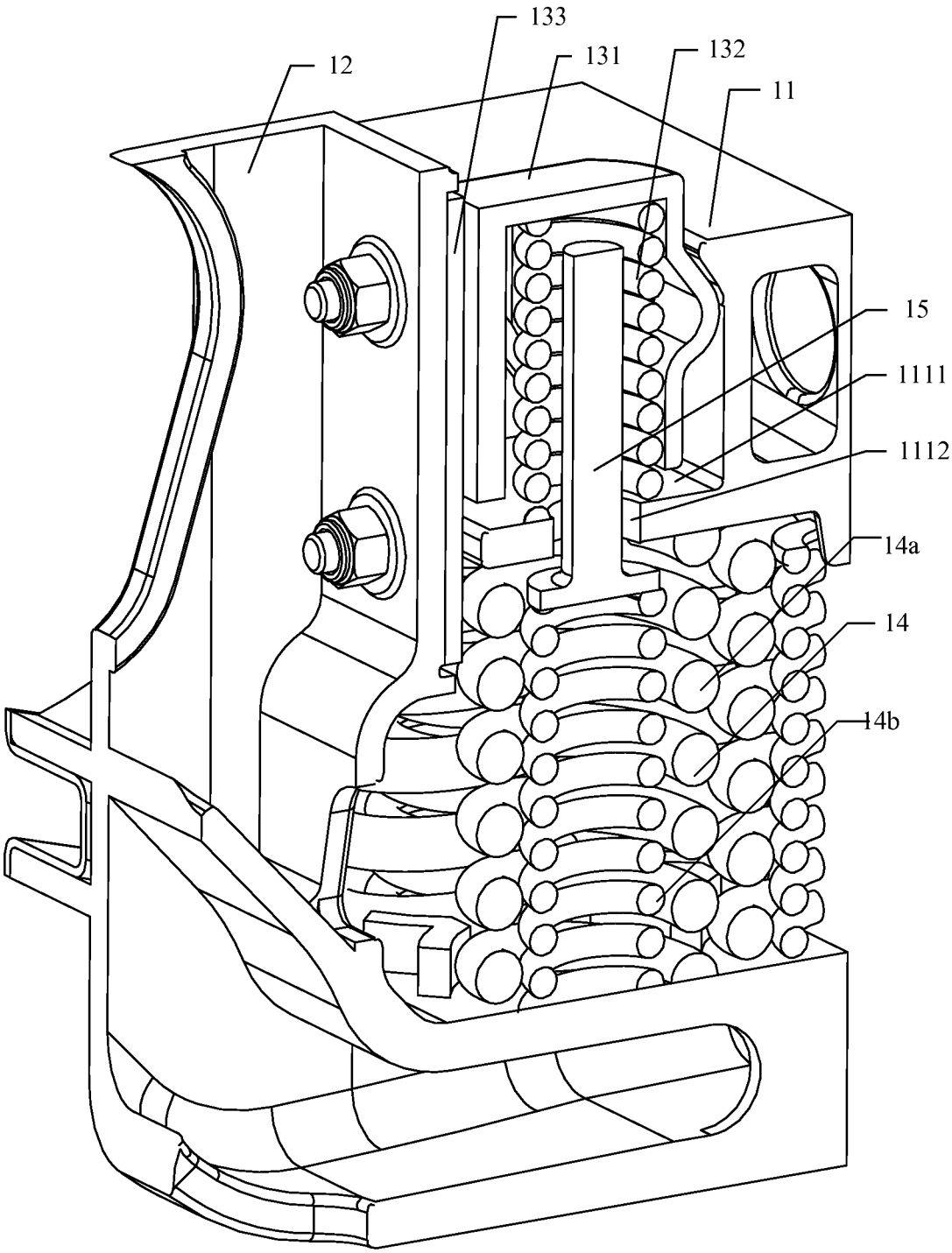
FIG. 4 is a partial three dimensional view of a bogie with a constant contact damper of the present invention.
Figure 5:
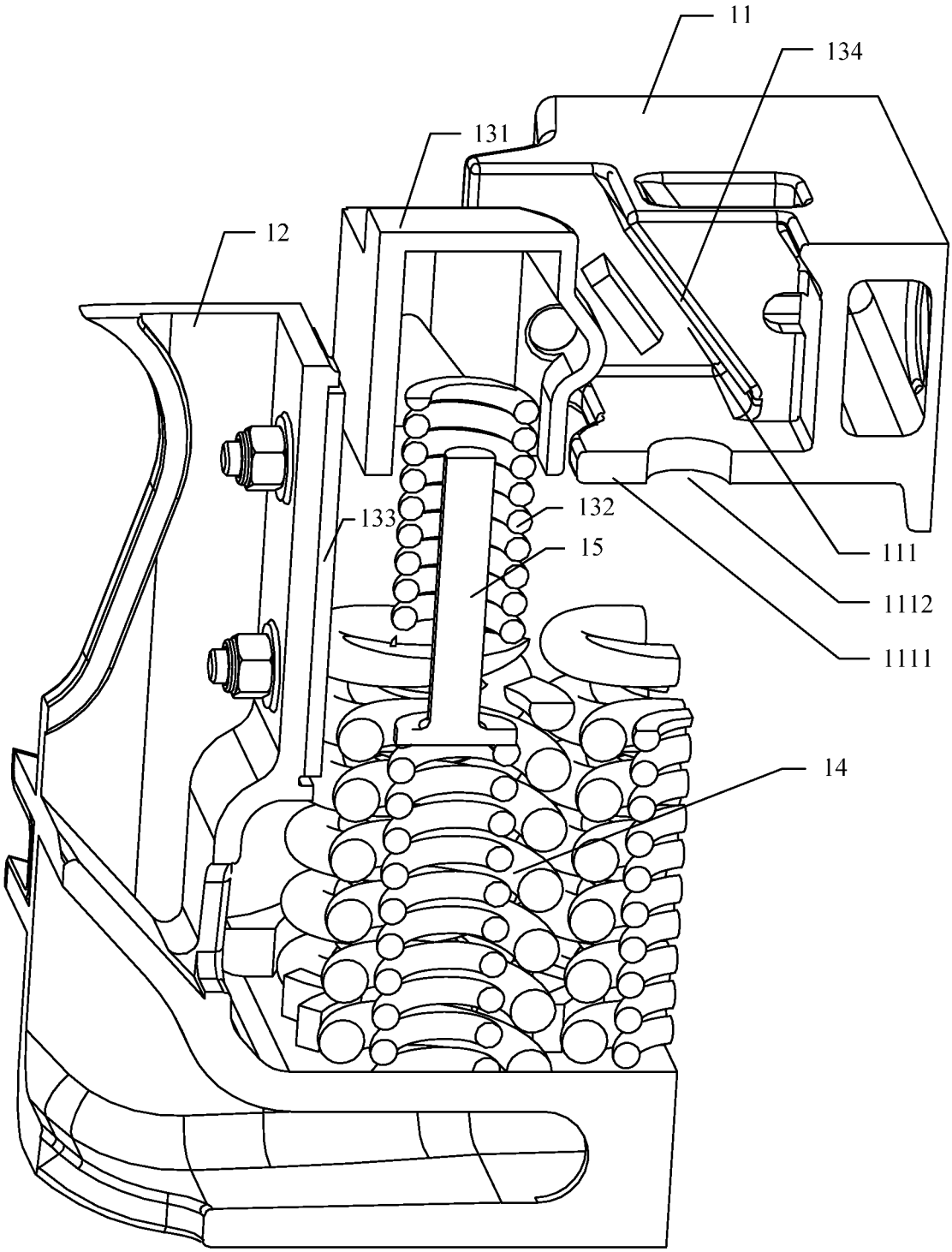
FIG. 5 is another partial three dimensional view of the bogie with the constant contact damper of the present invention.
Figure 6:
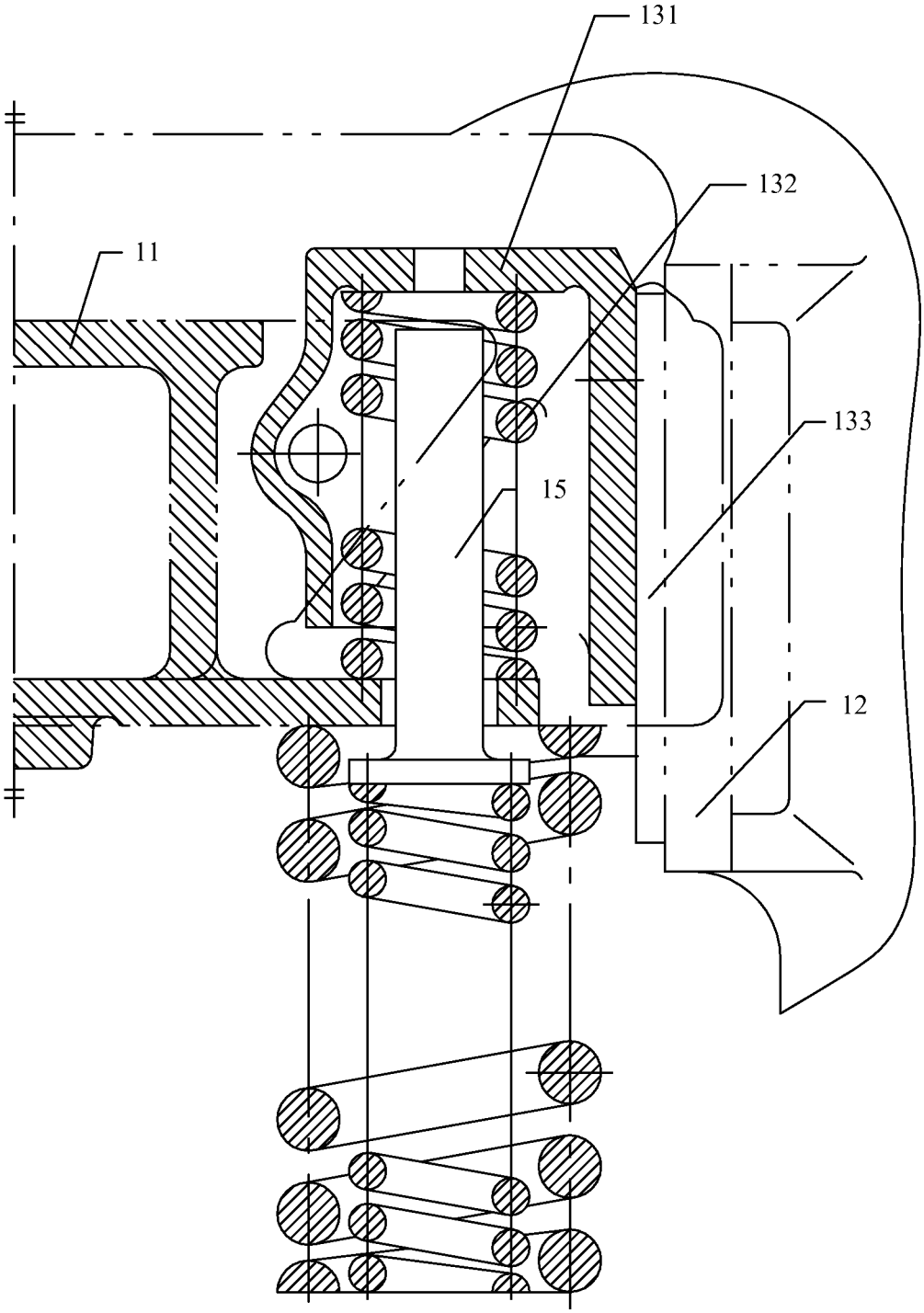
FIG. 6 is a partial side view of the bogie with the constant contact damper of the present invention.

FIG. 4 is a partial three dimensional view of a bogie with a constant contact damper according to an embodiment of the present invention, FIG. 5 is another partial three dimensional view of the bogie with the constant contact damper according to an embodiment of the present invention, and FIG. 6 is a partial side view of the bogie with the constant contact damper according to an embodiment of the present invention.

Referring to FIG. 1 to FIG. 6, the bogie with the constant contact damper according to the embodiment of the present invention is improved based on the prior art structure. Besides a bolster 11, two side frames 12 and four constant contact dampers, as well as each of the constant contact dampers has a wedge 131 and a damping spring 132, a side frame column wear plate 133 and a bolster inclined plane wear plate 134 (no further details in their connection relationship will be given here), the bogie further comprises four through holes 1112 and four ejectors 15 which respectively correspond to the four constant contact dampers.

The related structure of the bogie of the embodiment will be described using one set of through hole 1112, ejector 15 and constant contact damper as representative. Through hole 1112 is arranged on a bottom plate 1111 of a wedge pocket 111 included in the bolster 11, and the position of the through hole 1112 on the bottom plate 1111 corresponds to the position where the damping spring 132 bears against the bottom plate 1111 and a load spring 14 of the bogie. One end of the ejector 15 penetrates into the damping spring 132 along the axial direction of the damping spring 132 which is a coil spring in the embodiment shown in FIG. 4, and when a car is empty, a predetermined distance is reserved between this end of the ejector 15 and the top inner surface of the inner cavity of the wedge 131, and the damping spring 132 is in a compression state all the time. The other end of the ejector 15 bears against the load spring 14 through the through hole 1112. Specifically, the load spring 14 comprises an inner spring 14*b* and an outer spring 14*a*, and the inner spring 14*b* is embedded inside the outer spring 14*a*. The other end of the ejector 15 can bear against the inner spring and/or the outer spring. In the embodiment shown in FIG. 4, the other end of the ejector 15 bears against the inner spring. A flange is formed at this end of the ejector 15 for contacting with the load spring 14. In the embodiment shown in FIG. 4, the flange of the ejector 15 has a dimension corresponding to the lateral cross sectional dimension of the inner spring 14*b* which is a coil spring in this embodiment, so that the flange can contact and press the inner spring 14*b* at the upper end of the inner spring 14*b*. In other embodiment, the flange of the ejector 15 may have a dimension corresponding to the lateral cross sectional dimension of the outer spring 14*a* which can be a coil spring, so that the flange can contact and press the outer spring 14*a* at the upper end of the outer spring 14*a*.

In the practical application, when the car is empty, the position of the bolster 11 is high and the length of the ejector 15 is shorter than the distance between the top inner surface of the inner cavity of the wedge 131 and the top surface of the inner spring 14*b* such that the ejector 15 does not contact with the top inner surface of the inner cavity of the wedge 131 while sitting on the inner spring 14*b*. In this case, the upward elastic force of the inner spring 14*b* on the ejector 15 is not enough for one end of the ejector 15 to contact the top inner surface of the inner cavity of the wedge 131, and thus only the vertical support force generated by the damping spring 132 in a compression state is converted to the horizontal lateral pressure on the side frame 12 and the inclined plane lateral pressure on the wedge pocket 111 from the wedge 131. The vertical support force is designed to be small and is suitable for the empty car.

When the car is loaded, all of the bolster springs, which comprise the load spring 14 as a part of the bolster springs arranged at the bottom of the wedge 131, of the car bear the total weight of the car and the freight such that the bolster 11 moves downward. In this case, the distance between the top inner surface of the inner cavity of the wedge 131 and the top surface of the inner spring 14*b* becomes shorter such that the ejector 15 and the top inner surface of the inner cavity of the wedge 131 come into contact with each other. Thereby, the inner spring 14*b* is compressed to support the ejector 15 vertically and elastically, and the vertical elastic force of the inner spring 14*b* is transferred via the ejector 15 and acts together with damping spring 132 on the top of the inner cavity of the wedge 131. At that time, the vertical support force generated by the compressed inner spring 14*b* together with the compressed damping spring 132 is significantly larger than that when the car is empty. Correspondingly, the horizontal lateral pressure on the side frame 12 and the inclined plane lateral pressure on the wedge pocket 111 from the wedge 131 are increased as well and thus the damping force is increased at the same time, which meets the requirement in the loaded status.

The bogie of the embodiment adopts a structure that has through holes formed on the bottom plate of the wedge pocket of the bolster and one end of the ejector penetrates into the damping spring, and the other end of the ejector bears against the load spring through the through hole, which structure combines the damping spring laid on the bolster with the wedge. Compared with the constant contact damper in the prior art, the constant contact damper of the embodiment has changes in its characteristics. In the empty-load status, only the damping spring provides the vertical support force which is converted to damping force; while in the loaded status, both of the damping spring and the load spring provide the vertical support forces which are converted to damping force. Thereby, the embodiment adapts for both the empty-load status and the loaded status. In this way, the relative friction coefficient of the damper is around an ideal value whether in the empty-load status or the loaded status. Further, the wedge in the embodiment is the same one as in the prior art and the width thereof is large and not changed, such that the control force for the side frame is strong which makes the bogie have great anti-lozenge deformation rigidity. From what is described above, the embodiment has an ideal relative friction coefficient in both the empty-load status and the loaded status, which improves the damping effect of the bogie and makes the bogie have great anti-lozenge deformation rigidity as well.

Finally, it should be understood that the above embodiments are only used to explain, but not to limit the technical solution of the present invention. It should be understood by those of ordinary skill in the art that although the present invention has been described in detail with reference to the foregoing embodiments, modifications or equivalent replacements can be made to the technical solutions of the present application, as long as such modifications or replacements do not cause the essence of corresponding technical solutions to depart from the scope of the present invention.

What is claimed is:

1. A bogie, comprising a bolster, two side frames, four constant contact dampers, and four load springs, wherein two sides of two ends of the bolster are respectively provided with a wedge pocket having a bottom plate; the four constant contact dampers are respectively arranged in four wedge pockets above the bottom plate and the four load springs are respectively arranged below the bottom plate, and each of the four constant contact dampers comprises a wedge and a damping spring; the damping spring is arranged in an inner cavity of the wedge; one end of the damping spring bears against a top inner surface of the inner cavity of the wedge, and the other end of the damping spring bears against the bottom plate of the wedge pocket;

wherein the bogie further comprises four through holes arranged on the bottom plate and four ejectors which respectively correspond to the four constant contact dampers;

the position of each of the four through holes on the bottom plate corresponds to the position where the damping spring bears against the bottom plate and the load spring of the bogie is located; and one end of the ejector penetrates into the damping spring through the through hole, and the other end of the ejector bears against the load spring.

2. The bogie of claim 1, wherein the load spring comprises an inner spring and an outer spring, and the inner spring is embedded inside the outer spring.

3. The bogie of claim 2, wherein the other end of the ejector bears against the inner spring and/or the outer spring.

4. The bogie of claim 1, wherein a predetermined distance between said one end of the ejector and the top inner surface of the inner cavity of the wedge is reserved when a car is empty.

5. The bogie of claim 1, wherein the load spring is compressed to bear against the other end of the ejector and said one end of the ejector bears against the top inner surface of the inner cavity of the wedge when the car is loaded.

6. The bogie of claim 1, wherein the ejector has a solid cylindrical body and a solid disc at a lower end of the cylindrical body, an upper portion of the cylindrical body penetrates into the damping spring, and the solid disc of the ejector bears against the load spring.

* * * * *